US005800086A

United States Patent [19]

Piscopo et al.

[11] Patent Number: 5,800,086

[45] Date of Patent: Sep. 1, 1998

[54] DISPENSER - APPLICATOR

[75] Inventors: Peter Piscopo, Medford, N.J.; Richard H. Seager, Mystic, Conn.

[73] Assignee: The Plastek Group, Erie, Pa.

[21] Appl. No.: 728,067

[22] Filed: Oct. 9, 1996

[51] Int. Cl.[6] ..... A45D 40/02

[52] U.S. Cl. ..... 401/82; 401/84

[58] Field of Search ..... 401/82, 83, 84, 401/55

[56] References Cited

U.S. PATENT DOCUMENTS

| | | | |
|---|---|---|---|
| 1,494,736 | 5/1924 | Cottrell | 401/83 |
| 3,443,874 | 5/1969 | Pelli et al. | 401/82 |
| 4,298,036 | 11/1981 | Horvath | 401/55 X |
| 4,621,935 | 11/1986 | Sussman | 401/82 |
| 5,167,462 | 12/1992 | Lucas | 401/82 |
| 5,356,037 | 10/1994 | Harrold . | |
| 5,421,663 | 6/1995 | Bravo . | |

*Primary Examiner*—Steven A. Bratlie
*Attorney, Agent, or Firm*—Bachman & LaPointe, P.C.

[57] ABSTRACT

A dispenser having an elevator for advancing product disposed within a housing having opposed, through sidewall slots. The slots are formed with ratchets and the elevator is actuated by a driver extending through and guided by slots. The driver is formed with pawls which engage the ratchets so that the elevator can be indexed manually in step by step fashion.

3 Claims, 2 Drawing Sheets

DISPENSER - APPLICATOR

BACKGROUND OF THE INVENTION

The present invention relates to a dispenser - applicator. That is, a unit containing solid or semi-solid product where the product is advanced incrementally for subsequent application to a surface.

While the invention is not so limited a typical product may include deodorants, anti-perspirants, depilatories and the like.

SUMMARY OF THE INVENTION

The invention embraces a structure for advancing a product in step by step fashion using a novel arrangement of a ratchet and pawl system.

The invention relates as well to a novel method of loading and molding a product where the product is heated initially to render it pourable. Thereafter the product is chilled within its container to assume a solid or semi-solid state.

A further feature of the invention is the provision of a closure means which includes a first disposable closure utilized as a mold and a second closure serving as an outer cap which is removable to expose the product for use and replaceable to protect the product when not in use.

One aspect of the invention involves a hollow barrel or housing containing a product elevator where the sidewall of the barrel is formed with opposed through slots formed with linear ratchets. The elevator is actuated manually by a driver having pawls which engage the ratchets. Portions of the driver project through the slots terminating in tabs which when engaged manually are operable to index the driver and thus the elevator to advance product in step by step fashion.

The elevator is supported by a tubular member which also serves as a product fill tube.

In addition, the driver acts, after filling, as a closure for the fill tube and a closure for the bottom of the barrel.

The method aspects of the invention involve providing a product which is pourable when heated and sets up or gels into a solid or semi-solid condition when cooled.

The upper end (applicator end) of the barrel is fitted with a disposable closure which serves as a mold, usually configured to create a dome shape. The barrel is then positioned (inverted) to expose the tubular fill member providing a conduit leading to the elevator.

Pourable product, heated to a temperature ranging from 120° to 150° F., is introduced in the tubular fill member loading the elevator and filling the barrel including the disposable mold.

Next the product is chilled to a temperature ranging from 38° to 45° F. causing the product to set up or gel.

Thereafter the driver is snapped in place closing the tubular fill member and the bottom of the barrel with the driver pawls engaging the ratchets.

The outer cap is applied and the unit is now in condition for utilization by the user.

The user upon receipt of the loaded dispenser - applicator places the unit in operation by removing the second closure (outer cap) discarding the first disposable closure thereby exposing the product for use.

The product is then ready for application and as the product is diminished by use, the driver tabs are grasped and are manually operable to move product outwardly into a useful position in step by step fashion as necessary.

BRIEF DESCRIPTION OF THE DRAWINGS

Other features and advantages of the present invention will become apparent from an examination of the succeeding specification when read in conjunction with the appended drawings, in which.

DESCRIPTION OF THE PREFERRED EMBODIMENT

Figure 1:
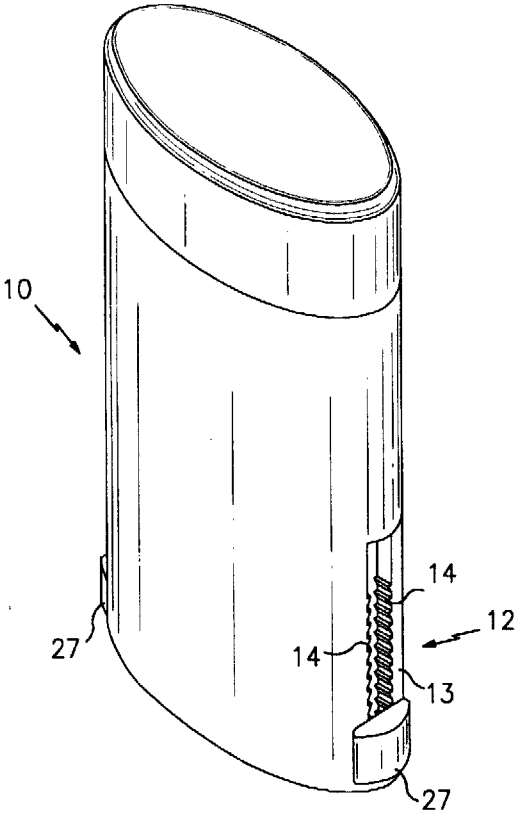
FIG. 1 is a perspective view of a dispenser - applicator embracing principles of the present invention.
Figures 2, 5:
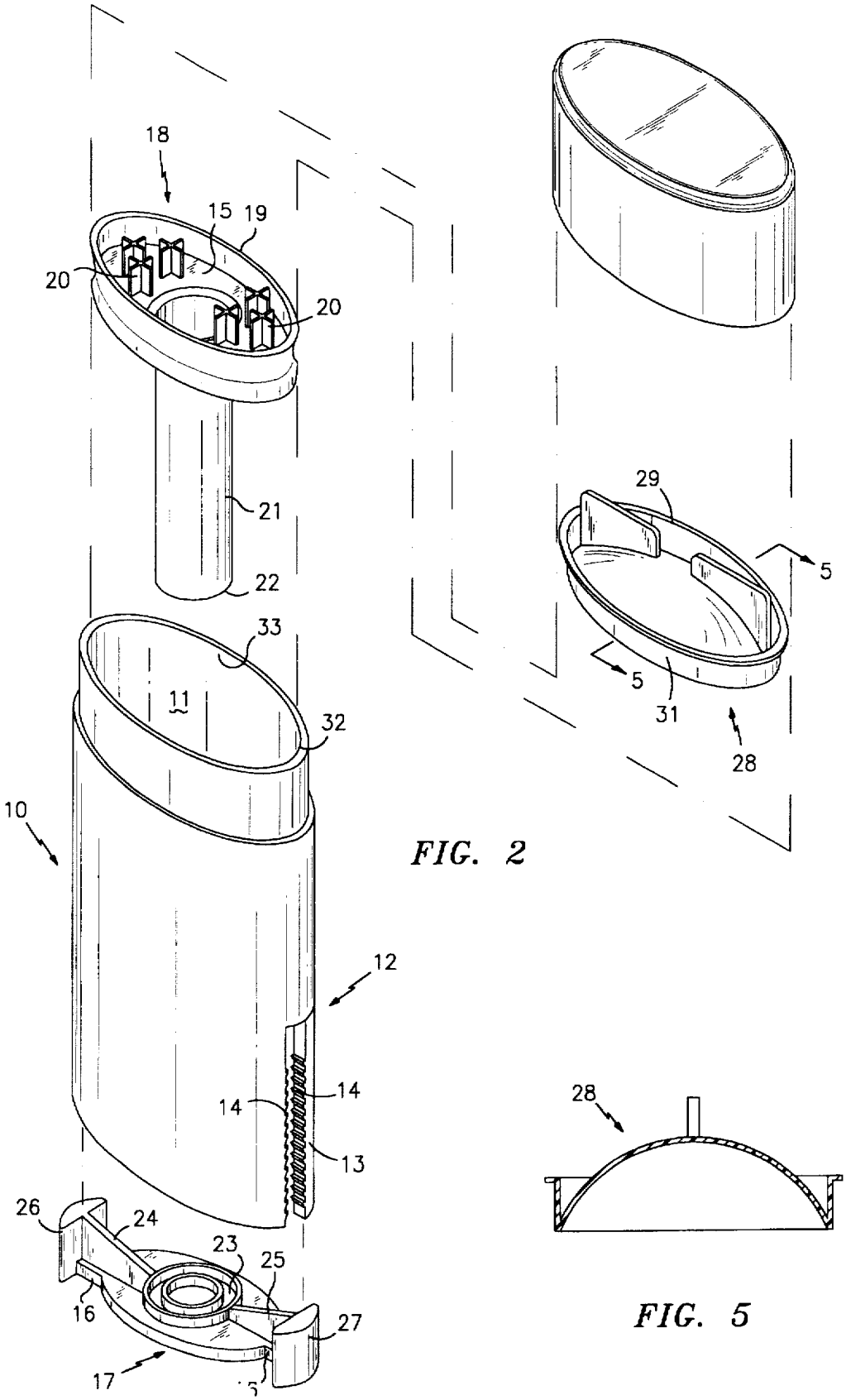
FIG. 2 is an exploded view showing details of the unit of FIG. 1.
FIG. 5 is a vertical section of the first disposable closure taken along the line 5—5 of FIG. 2 to show its internal mold configuration.

Referring to FIGS. 1 and 2 the reference numeral 10 designates a dispenser - applicator having an oval shaped barrel 11 whose sidewall at 12 is formed with opposed slots 13 (only one shown). Opposed sides of each of the slots are formed with linear ratchets 14 engagable with pawls 16 carried by a driver 17.

Disposed in the barrel 11 is an elevator 18 making snug frictional contact with the barrel as the lip 19 thereof engages the internal surface of the barrel. The elevator 18 includes a set of ribs or protuberances 20 for keying product to the elevator. The elevator 18 includes a tubular member 21 which acts dually as a piston rod, supporting the elevator body 15, and as a fill pipe.

The terminal end 22 of the tubular member 21 engages the annulus 23 of driver 17 operable to close the tubular member as the pawls of the driver engage mating ratchets. The driver also serves as a closure for the bottom of the barrel 11.

Ribs 24 and 25 strengthen the overall structure of the driver and support manually operable finger tabs 26 and 27 used to advance a loaded elevator.

First closure 28 is disposable and includes a peripheral rim 29 and a skirt 31 so that the closure 28 is removably received within the barrel as the rim 29 seats upon the top 32 of the barrel as the skirt 31 snugly and frictionally engages the interior of the barrel as at 33.

Note that first closure 28 serves a product mold and is disposable by user of the dispenser - applicator.

Figure 4:
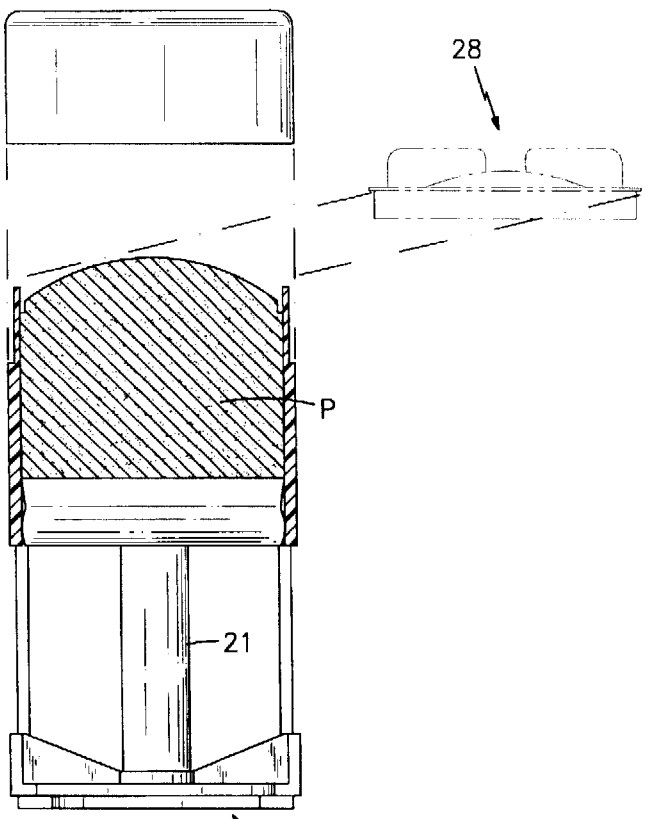
FIG. 4 is a vertical section of the unit of FIG. 1 with the first and second closures removed showing the product exposed for the user.
Figure 3:
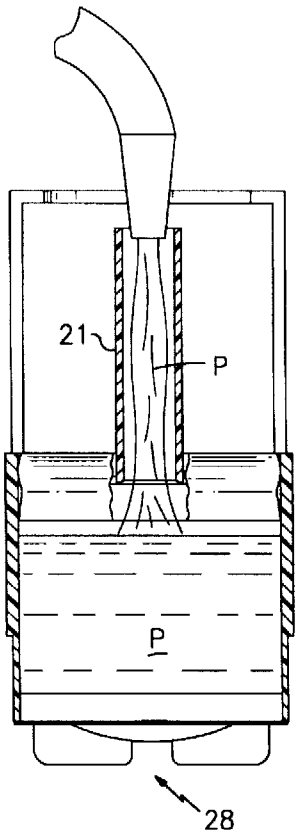
FIG. 3 shows a typical product loading step with the dispenser - applicator inverted.

Referring to FIGS. 3, 4 and 5, the elevator loading step is shown. That is, the barrel, with the elevator snugly in place and the first disposable closure in molding position, is inverted so that warm product P is fed to the elevator via the piston or fill tube 21. After gelling the product is keyed to the elevator by the ribs 20 and the unit is placed in the position shown in FIG. 4.

The customer upon purchase of the dispenser - applicator removes the secondary closure, discards the first disposable closure and is free to apply the product as desired.

As the dome - wears or erodes the tabs 27—27 - are grasped to advance the driver and thus the elevator to expose the product as necessary.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A dispenser for applying a solid product to a surface comprising:

a barrel having an oval shape in cross-section with a major axis, a sidewall and top and bottom open ends, a first disposable barrel closure, said first disposable closure comprising a peripheral rim and a depending skirt whereby said skirt is received within said barrel and the rim is seated on the top open end of the barrel, said first disposable closure when in a closed position operating additionally as a product mold, a portion of said sidewall being formed with opposed through slots at the ends of said major axis, said slots extending vertically from a bottom open end of the sidewall terminating at a point which is substantially equidistant from said top and bottom open ends, an elevator disposed in said barrel having a body connected to a hollow rod, said hollow rod having an open end and being operable dually to support the elevator and to provide a conduit leading to the body for loading the elevator, said elevator body being disposed normally above the terminating point of said slots, said slots being formed with opposed ratchet teeth, and a driver having opposed pawls which are operable to engage and move along said ratchet teeth in step by step fashion, said driver being formed with an annulus which is operable to receive said open end of said hollow rod thereby closing said open end of said hollow rod, said driver being further operable to effect and maintain closure of the bottom end of the barrel as the pawls engage and move along mating ratchet teeth in said step by step fashion after loading of the elevator, said driver being formed with a pair of manually operable, opposed exterior finger tabs extending from said pawls for advancing the driver and thus the elevator, said finger tabs including opposed inwardly projecting ribs carried by the driver for stabilizing the pawls, the finger tabs and the driver, said ribs being disposed within the interior of the barrel and being received movably in said slots.

2. The dispenser of claim 1 wherein the elevator body includes a set of protuberances for keying product to the elevator body.

3. The dispenser of claim 2 wherein a secondary removable closure overlaps the first disposable closure and operates to close the top open end of the barrel.

* * * * *